US010082027B2

(12) United States Patent
MacPhee et al.

(10) Patent No.: US 10,082,027 B2
(45) Date of Patent: Sep. 25, 2018

(54) PISTON UNIT AND HYDROSTATIC RADIAL-PISTON MACHINE

(71) Applicant: Robert Bosch GmbH, Stuttgart (DE)

(72) Inventors: Adam MacPhee, Kircaldy (GB); Geoffrey Kermode, Edinburgh (GB); Kevin Kilroy, Glasgow (GB)

(73) Assignee: Robert Bosch GmbH, Stuttgart (DE)

( * ) Notice: Subject to any disclaimer, the term of this patent is extended or adjusted under 35 U.S.C. 154(b) by 252 days.

(21) Appl. No.: 14/994,602

(22) Filed: Jan. 13, 2016

(65) Prior Publication Data

US 2016/0201461 A1 Jul. 14, 2016

(30) Foreign Application Priority Data

Jan. 13, 2015 (DE) ..... 10 2015 200 310

(51) Int. Cl.

| | |
|---|---|
| ***F01B 1/00*** | (2006.01) |
| ***F01B 1/06*** | (2006.01) |
| ***F04B 1/04*** | (2006.01) |
| ***F04B 1/047*** | (2006.01) |
| ***F04B 1/107*** | (2006.01) |
| *F01B 9/06* | (2006.01) |

(52) U.S. Cl.

CPC ..... *F01B 1/0644* (2013.01); *F01B 1/0603* (2013.01); *F01B 1/0651* (2013.01); *F01B 1/0655* (2013.01); *F04B 1/0408* (2013.01); *F04B 1/0474* (2013.01); *F04B 1/107* (2013.01); *F01B 9/06* (2013.01)

(58) Field of Classification Search

CPC .... F01B 1/0603; F01B 1/0651; F01B 1/0655; F04B 1/0474; F04B 1/107

USPC ..... 92/72

See application file for complete search history.

(56) References Cited

U.S. PATENT DOCUMENTS

| | | | | |
|---|---|---|---|---|
| 4,144,799 | A * | 3/1979 | Ponchaux | F01B 1/0631 91/488 |
| 6,276,261 | B1 * | 8/2001 | Manfreda | F01B 1/0644 92/255 |
| 2013/0064490 | A1 * | 3/2013 | Brock, II | F16C 9/04 384/625 |
| 2013/0228071 | A1 * | 9/2013 | Nagel | F04B 1/0408 92/178 |

FOREIGN PATENT DOCUMENTS

| | | |
|---|---|---|
| DE | 39 26 185 C2 | 2/1991 |
| DE | 40 37 455 C1 | 2/1992 |
| DE | 101 60 555 A1 | 6/2002 |
| DE | 102 12 492 B4 | 10/2003 |
| DE | 10 2005 035 082 A1 | 2/2007 |
| DE | 10 2009 001 314 A1 | 9/2010 |

(Continued)

OTHER PUBLICATIONS

German Search Report corresponding to German Application No. 10 2015 200 310.8, dated Jul. 29, 2015; Munich, Germany (9 pages).

*Primary Examiner* — Thomas E Lazo
*Assistant Examiner* — Daniel Collins
(74) *Attorney, Agent, or Firm* — Maginot, Moore & Beck LLP

(57) ABSTRACT

A piston unit includes a piston which has a rolling element seat configured to rotatably support a rolling element. The rolling element seat has a bearing surface with a surface coating composed of a polymer compound or with a ceramic surface coating.

12 Claims, 1 Drawing Sheet

(56) References Cited

FOREIGN PATENT DOCUMENTS

| | | | |
|---|---|---|---|
| DE | 10 2009 038 418 | A1 | 2/2011 |
| DE | 10 2010 015 417 | A1 | 10/2011 |
| DE | 20 2013 101 137 | U1 | 5/2013 |
| DE | 10 2012 223 348 | A1 | 6/2014 |
| DE | 10 2013 206 192 | A1 | 10/2014 |

* cited by examiner

PISTON UNIT AND HYDROSTATIC RADIAL-PISTON MACHINE

This application claims priority under 35 U.S.C. § 119 to patent application number DE 10 2015 200 310.8, filed on Jan. 13, 2015 in Germany, the disclosure of which is incorporated herein by reference in its entirety.

BACKGROUND

The disclosure relates to a piston unit and to a hydrostatic radial-piston machine having such a piston unit.

DE 40 37 455 C1, for example, discloses a hydrostatic radial-piston machine of generic type. This radial-piston machine comprises a rotor designed as a cylinder block, in which multiple piston units are displaceably guided in a radial direction. Each of these piston units has a piston, which is guided in a cylinder bore of the cylinder block and the end portion of which projecting from the cylinder block in a radial direction is supported via a rolling element on a cam plate, fixedly accommodated in a housing of the hydrostatic radial-piston machine, so that the pistons perform a lift corresponding to a lifting cam of this cam plate. One disadvantage of such piston units is that friction occurs between the piston and the rolling element interacting with this, which reduces the efficiency of a hydrostatic radial-piston machine and in particular its starting efficiency.

Various technical solutions have already been proposed to counter this disadvantage. DE 39 26 185 C2, for example, proposes that a bearing shell composed of a composite material be arranged in a roller seating compartment of a piston. The bearing composite material used for this purpose may be composed, for example, of a steel substrate with a bronze layer and a plastic layer supporting the roller. Although comparatively good friction characteristics can thereby be obtained between the seated roller and the roller seating compartment, an even greater reduction in the friction is desirable. Moreover, the production and (pre-) assembly of the bearing composite material as bearing shell prove to be relatively costly.

DE 10 2013 206 192 A1 proposes another technical solution for reducing the friction of a radial-piston machine. Here it is proposed to polish at least one surface of a piston. For this purpose, it is proposed to produce the rolling element seat from a bearing material which comprises a plastic and/or metal composite material. Although these measures achieve a comparatively high starting efficiency by reducing friction, there is still a desire for an optimal solution in terms of friction which also ensures relative ease of manufacture and assembly.

In contrast to this, the object of the disclosure is to create a piston unit and a hydrostatic radial-piston machine constructed with such a piston unit, in which the starting efficiency is improved by using the simplest possible design and/or technical production means.

SUMMARY

This object is achieved in respect of the piston unit by the combination of features described below and in respect of the hydrostatic radial-piston machine by the combination of features in the following description.

The piston unit of a hydrostatic machine comprises a piston having a rolling element seat for rotatably supporting a rolling element. According to the disclosure the rolling element seat has a bearing surface with a surface coating composed of a preferably self-curing polymer compound or alternatively a ceramic surface coating. Surprisingly it has emerged that, through the use of a surface coating composed of a preferably self-curing polymer compound or a ceramic surface coating, the starting torque of a new hydrostatic radial-piston machine that has not yet been run in is significantly less than the starting torque of a conventional hydrostatic radial-piston machine. In particular, such a coated bearing surface of the rolling element seat serves to reduce the (boundary) friction between the rolling element seat and the rolling element considerably, and therefore significantly increases the starting efficiency of the piston unit. The service life of a hydrostatic radial-piston machine can thereby also be improved by a piston unit according to the disclosure.

Here the polymer compound may be a polyetherketone (PEEK)-based coating, for example. A coating product marketed by Messrs. Victrex® under the tradename VICOTE®, for example, has proved particularly suitable for the disclosure. This is a VICTREX® PEEK polymer-based coating product. The VICOTE® 800-series coatings, in particular the 807, 810, 812, 816 and 817 types, for example, are suitable for the use according to the disclosure.

The alternative ceramic surface coating may be a ceramic material which can be applied as a coating and is formulated for optimum friction. The relatively high thermal, mechanical, tribological and corrosive load-bearing capacities make such a coating outstandingly suitable for the use according to the disclosure.

In an especially advantageous development of the disclosure the polymer compound applied to the bearing surface of the toolholder has a layer thickness of approximately 40 to 80 μm, preferably 50 to 75 μm. A layer thickness of precisely 40 μm, precisely 80 μm or also, for example, 55 μm and so on may therefore be provided, for example. It has advantageously been shown that even such comparably thin layers are sufficient to achieve a significantly improved friction behavior.

For the easiest possible application of the coating during the manufacturing process, it may be advantageous for the polymer compound to be in the form of a dispersion before it is applied.

In a further advantageous development of the disclosure the polymer compound is applied at least twice in at least two layers. These may be applied in at least two successive coating operations, for example. It is thereby possible to adjust or adapt the tribological characteristics of the coated bearing surface of the toolholder even more precisely to the particular requirements of the radial-piston machine.

In addition, the polymer compound in a first layer, for example the layer of a first coating operation, may advantageously differ from the polymer compound in a second layer, for example the layer of a second coating operation.

In an alternative design variant, in which the bearing surface has the ceramic surface coating, it is advantageous if the ceramic surface coating has a layer thickness of 25 to 35 μm.

For easiest possible application of the respective surface coating and for optimum control of the layer thickness, it may be advantageous if the surface coating is applied to the bearing surface in the form of an aerosol. Here too, for example, it is possible to control the aerosol precipitation process in order to achieve a uniform, in particular even layer thickness of the respective surface coating. This is also a good way of adjusting any radial play between the rolling element to be supported and the rolling element seat.

In order to minimize the outlay for preassembly of the piston unit, it is advantageous if the bearing surface is integrally formed with the piston. That is to say the bearing surface is formed by the use of a suitable, preferably metal-cutting or chip-forming production process directly on the rolling element seat, and the surface coating is then applied to this seat. A tool may be used, for example, which first performs a roughing cut and then a fine cut for precise forming of the bearing surface. Then broaching is performed as an aftertreatment production process. Consequently, there is no need for a separately formed piston seat in the form of bearing shell or the like. The number components used in the piston unit can thereby be reduced, so that the outlay during pre-assembly is reduced.

In a further advantageous development of the disclosure the rolling element is supported directly on the bearing surface or in the rolling element seat integrally formed therewith. That is to say there is no intermediate component, such as a bearing shell, for example, arranged between them. This also obviates the need for any steps for holding a bearing shell or the like on the rolling element seat, so that overall the geometry of the rolling element seat is simplified. This serves further to reduce the production outlay and the manufacturing costs.

In a further advantageous design variant of the disclosure the surface coating of the bearing surface extends so far in the longitudinal direction of the piston that the rolling element can be at least partially supported in a radial direction of the piston.

A hydrostatic radial-piston machine according to the disclosure comprises a cylinder block, in which at least one piston unit according to the disclosure with polished piston is guided. An outstanding feature of such a radial-piston machine is a relatively high starting efficiency, since the (boundary) friction between the rolling element seat of the respective piston unit and the rolling element supported therein is relatively low. Moreover, it is possible, in the case of the piston unit, to dispense with a separately fitted piston seat, for example in the form of a bearing shell formed separately from the rolling element seat. This also simplifies the production and assembly process and therefore reduces the manufacturing costs for the radial-piston machine.

A referred exemplary embodiment of a piston unit according to the disclosure and a hydrostatic radial-piston machine constructed with such a piston unit are represented in the drawing. The disclosure is now explained in more detail with reference to the figures of this drawing.

BRIEF DESCRIPTION OF THE DRAWINGS

In the drawing.

In the figures the same components are provided with the same reference numerals throughout.

DETAILED DESCRIPTION

Figure 1:
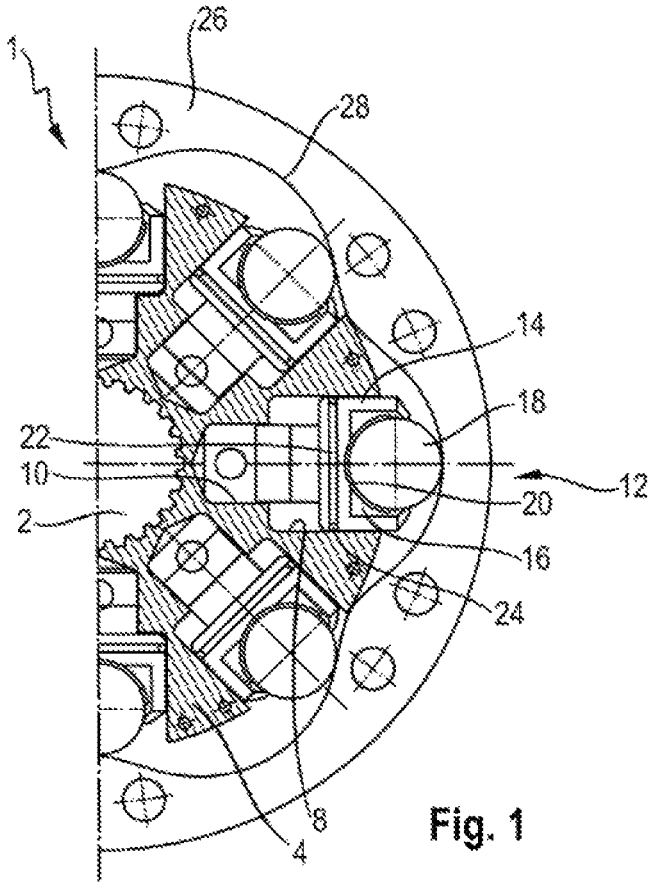
FIG. 1 shows a section through a part of a hydrostatic radial-piston machine having a piston unit according to the disclosure.

FIG. 1 shows an exemplary embodiment of a hydrostatic radial-piston machine 1 according to the disclosure in a section perpendicular to its axis of rotation. In this exemplary embodiment the hydrostatic radial-piston machine 1 is a radial-piston motor having an outer piston support. The basic working principle of such a hydrostatic radial-piston machine is described, for example, in DE 40 37 455 C1.

The hydrostatic radial-piston machine 1 comprises a centrally arranged shaft 2, which serves to drive an element (not represented here) affixed thereto. The shaft 2 is driven by a rotating rotor 4, in which multiple cylinders 6 are formed. In the exemplary embodiment the hydrostatic radial-piston machine 1 comprises precisely eight cylinders 6, of which only three are fully represented in FIG. 1, together with halves of two further cylinders. The cylinders 6 are arranged radially or in a star-shaped pattern around the shaft 2. Each cylinder 6 moreover has a main bore 8 and a radially back-stepped guide bore 10, in each of which a piston unit 12 is moveably accommodated.

Each of the piston units 12 comprises a piston 14, which in the exemplary embodiment shown is a stepped piston. At an outer end in a radial direction of the hydrostatic radial-piston machine 1, each piston 14 has a cylindrical rolling element 16, which extends over an angle of more than 180 degrees and in which a rolling element 18 embodied as a roller is rotatably supported and held. For directly supporting the respective rolling element 18, each rolling element seat 16 has a respective bearing surface 20, which merely for illustrative purposes in this representation is shown to be relatively thick in its build-up or application. This is because in principle the bearing surface 20 is a relatively thinly coated surface, which cannot readily be represented on a drawing, and in particular not drawn true to scale. The rolling element seat 16 and the bearing surface 20 are integrally formed with the piston by a metal-cutting or chip-forming production process. Each piston 14 further comprises a circumferential groove 22 in which a piston ring 24 serving as sealing element is received.

The hydrostatic radial-piston machine 1 further comprises a fixed stroke ring 26, which represents a part of a housing and has a profiled cam track 28. This is arranged so that it rotates about the rotor 4 and therefore also about the cylinder 6 together with the piston unit 12. This arrangement allows the rolling elements 18 to be supported on the cam track 28 of the stroke ring 26 and to roll on the stroke ring 26 during a rotational movement of the rotor 4. Consequently, the piston units 12 perform an oscillating movement inside the cylinders 6.

Figure 2:
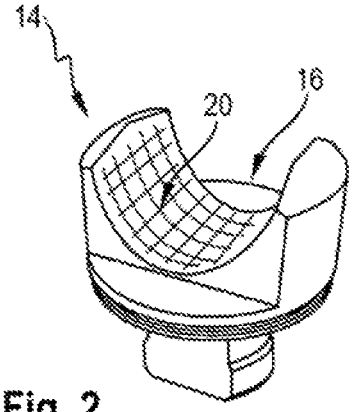
FIG. 2 shows a perspective top view of a piston from FIG. 1 with a bearing surface, coated according to the disclosure, of a rolling element seat
Figure 3:
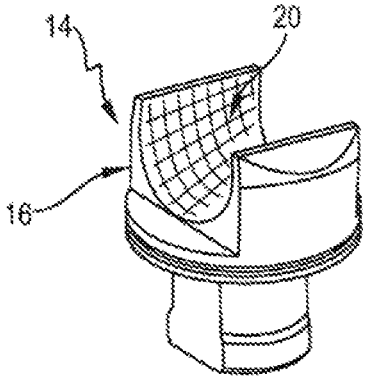
FIG. 3 shows a perspective side view of a piston from FIG. 1 with a bearing surface, coated according to the disclosure, of a rolling element seat.

The optimal-friction bearing surface 20 is described below with reference to FIGS. 2 and 3, which each show a perspective view of a piston 14 from FIG. 1. The bearing surface 20, as described above, is integrally formed with the rolling element seat 16 and therefore also integrally formed with the piston 14, using a metal-cutting or chip-forming production process. To improve the surface condition of the rolling element seat 18 or the bearing surface 20 integrally formed therewith, these are broached by a broaching tool following the shaping process. This integral formation of the bearing surface 20 with the rolling element seat 16 or the piston 16 dispenses with a bearing shell conventionally used as an intermediate component arranged between the rolling element seat 16 and the respective rolling element 18.

In order to reduce the (boundary) friction between the rolling element 18 to be seated and the bearing surface 20, the bearing surface 20 has a surface coating, which in this exemplary embodiment is composed of a polymer compound. A polyetherketone (PEEK)-based coating has been selected here. This is available from Messrs. Victrex® under the tradename VICOTE®. This is a VICTREX® PEEK polymer-based coating product which initially comes as a dispersion and as such is applied to the rolling element seat 16 in a single coating operation. The layer thickness of the surface coating of the bearing surface 20 is between 40 to 80 μm, preferably 50 to 75 μm. The bearing surface 20 is formed together with the surface coating up to an upper end of the rolling element seat 16 in FIG. 2 or 3. That is to say the bearing surface 20 extends so far in the axial direction of the piston 14 that the rolling element 18 can also be at least partially supported in a radial direction of the piston 14.

Starting from the exemplary embodiment represented, the piston unit 12 according to the disclosure and the hydrostatic radial-piston machine 1 equipped therewith can be modified in a variety of ways.

For example, the bearing surface 20 need not necessarily be formed with a surface coating composed of a polymer compound. An optimal-friction ceramic surface coating is also possible as an alternative to the polymer compound. In addition, the respective surface coating may also be applied gradually in multiple coating operations, in two or more layers. It is also possible to vary the precise material composition of the surface coating, particularly that of the polymer compound. With multiple layers of the surface coating, different material compositions of the individual layers are also possible.

In addition, the piston unit 12 need not necessarily be used in a hydrostatic radial-piston machine 1 with outer piston support, but may also advantageously be used in other technical applications. In particular, an application in hydrostatic radial-piston machines of another design type having no outer piston support is also feasible. Use in technical systems which are not radial-piston machines is also feasible.

A piston unit is disclosed, having a piston which comprises a rolling element seat for rotatably supporting a rolling element, together with a hydrostatic radial-piston machine constructed with at least one such piston unit. According to the disclosure the rolling element seat has a bearing surface with a surface coating composed of a polymer compound or with a ceramic surface coating.

LIST OF REFERENCE NUMERALS

1 radial-piston machine
2 shaft
4 rotor
6 cylinder
8 main bore of the cylinder
10 guide bore of the cylinder
12 piston unit
14 piston
16 rolling element seat of the piston
18 rolling element
20 bearing face with surface coating
22 circumferential groove of the piston
24 piston ring
26 stroke ring
28 lifting cam

What is claimed is:

1. A piston unit of a hydrostatic machine, comprising:
a piston including a rolling element seat configured to rotatably support a rolling element, the rolling element seat including a bearing surface,
wherein the bearing surface has a surface coating composed of a polymer compound,
wherein the polymer compound is applied in at least two layers, and
wherein the polymer compound in a first layer differs from the polymer compound in a second layer.

2. The piston unit as claimed in claim 1, wherein the polymer compound has a layer thickness of approximately 40 to 80 μm.

3. The piston unit as claimed in claim 1, wherein the polymer compound is a dispersion before it is applied.

4. The piston unit as claimed in claim 1, wherein the surface coating is applied to the bearing surface in the form of an aerosol.

5. The piston unit as claimed in claim 1, wherein the rolling element is supported directly on the bearing surface.

6. The piston unit as claimed in claim 1, wherein the surface coating of the bearing surface extends so far in a longitudinal direction of the piston that the rolling element is at least partially supported in a radial direction of the piston.

7. A piston unit, of a hydrostatic machine, comprising:
a piston including a rolling element seat configured to rotatably support a rolling element, the rolling element seat including a bearing surface,
wherein the bearing surface has one of a surface coating composed of a polymer compound and a ceramic coating, and
wherein the bearing surface is integrally formed with the piston.

8. The piston unit as claimed in claim 7, wherein the ceramic surface coating has a layer thickness of approximately 25 to 35 μm.

9. A hydrostatic radial-piston machine, comprising:
at least one piston unit including a piston, the piston having a rolling element seat configured to rotatably support a rolling element,
wherein the rolling element seat includes a bearing surface having a surface coating composed of a polymer compound,
wherein the polymer compound is applied in at least two layers,
wherein the polymer compound in a first layer differs from the polymer compound in a second layer, and
wherein the at least one piston unit is guided in a cylinder bore of a cylinder block.

10. The piston unit as claimed in claim 9, wherein the polymer compound has a layer thickness of approximately 40 to 80 μm.

11. The piston unit as claimed in claim 9, wherein the polymer compound is a dispersion before it is applied.

12. The piston unit as claimed in claim 9, wherein the surface coating of the bearing surface extends so far in a longitudinal direction of the piston that the rolling element is at least partially supported in a radial direction of the piston.

* * * * *